US005524523A

United States Patent [19]

Lübbe et al.

[11] Patent Number: 5,524,523

[45] Date of Patent: Jun. 11, 1996

[54] LOADING OF BOREHOLES WITH FLOWABLE EXPLOSIVES

[75] Inventors: Carl H. Lübbe, Kempton Park; Colin D. Wilson, Lonehill; Laurence J. P. Wilson, Modderfontein, all of South Africa

[73] Assignee: AECI Limited, Johanesburg, South Africa

[21] Appl. No.: 221,588

[22] Filed: Apr. 1, 1994

[30] Foreign Application Priority Data

Apr. 8, 1993 [ZA] South Africa ..... 93/2551

[51] Int. Cl.[6] ..... F42B 3/00

[52] U.S. Cl. ..... 86/20.15

[58] Field of Search ..... 86/20.15

[56] References Cited

U.S. PATENT DOCUMENTS

| | | | |
|---|---|---|---|
| 3,770,523 | 11/1973 | Biswas | 86/20.15 X |
| 3,774,496 | 11/1973 | Roach | 86/20.15 X |
| 3,791,255 | 2/1974 | Fox et al. | 86/20.15 X |
| 3,943,820 | 3/1976 | Persson | 86/20.15 X |
| 3,996,836 | 12/1976 | Lichtenberg | 86/20.15 X |
| 4,036,099 | 7/1977 | French | 86/20.15 X |
| 5,007,345 | 4/1991 | O'Garr | 102/313 |
| 5,105,743 | 4/1992 | Tano et al. | 86/20.15 X |
| 5,233,926 | 8/1993 | Carmichael et al. | 86/20.15 X |

*Primary Examiner*—Peter A. Nelson
*Attorney, Agent, or Firm*—Charles Q. Buckwalter

[57] ABSTRACT

The invention provides a method of loading flowable explosives into a borehole, and a lance suitable for use in the method, A plurality of different fluids are fed into the borehole along a plurality of separate conduits each forming part of the same lance, The lance comprises said separate conduits, arranged side-by-side.

6 Claims, 1 Drawing Sheet

LOADING OF BOREHOLES WITH FLOWABLE EXPLOSIVES

This invention relates to the loading of boreholes with flowable explosive. More particularly, the invention relates to a method of loading a flowable explosive into a borehole, and to apparatus for use in the method.

According to one aspect of the invention, there is provided a method of loading a flowable explosive into a borehole, which method comprises feeding a plurality of different fluids into the borehole along a plurality of separate conduits each forming part of a single lance inserted into the borehole.

The fluids may include two or more of flowable explosives, constituents of flowable explosives, borehole cleaning fluids such as air under pressure, flowable stemming materials, constituents of flowable stemming materials or the like. Thus, the fluids may be selected from flowable explosives, constituents of flowable explosives, borehole cleaning fluids, flowable stemming materials and constituents of flowable stemming materials.

The method may thus include the step, prior to the loading of the flowable explosive into the borehole, of cleaning the borehole by feeding, for example, air under pressure, via one of the conduits into the borehole.

Emulsion explosives will usually be loaded, but other flowable explosives with similar flow properties can also be loaded in accordance with the method.

As indicated above, the method may include inserting a plug of the flowable stemming material into the borehole to stem the explosive by feeding the flowable stemming material along one of the conduits.

Thus, the method may include, after feeding the flowable explosive or constituents thereof into the borehole, the step of inserting a plug of a flowable stemming material into the borehole, to stem the explosive in the borehole, by feeding the flowable stemming material or constituents thereof along one of the conduits into the borehole.

The flowable stemming material may be as described in the Applicant's co-pending South African Patent Application/Patent No. 93/6365.

Thus, in a particular embodiment of the invention, the method may include, in a single operation, feeding the flowable explosive, or its constituents, and the flowable stemming material, or its constituents, successively into the borehole by the steps of inserting the lance into a mouth of the borehole until an outlet end of the lance is adjacent a blind end of the borehole;

feeding the flowable explosive, or its constituents, into the borehole along a conduit of the lance;

withdrawing the lance from the borehole as the borehole receives flowable explosive, or its constituents, from the outlet end of the lance, the withdrawal and feeding being at rates which are synchronized with each other so that the volume of the borehole between said outlet end of the lance and the blind end of the borehole corresponds with the volume of explosive, or its constituents, which has been fed into the borehole;

inserting a plug of the flowable stemming material into the borehole, when the flowable explosive, or its constituents, has been loaded, by feeding the flowable stemming material, or its constituents, into the borehole along another conduit of the lance;

withdrawing the lance further from the borehole, as the borehole receives flowable stemming material, or its constituents, the further withdrawal and the feeding of the flowable stemming material being at rates which are synchronized with each other so that the volume of the borehole between said outlet end of the lance and the flowable explosive in the borehole corresponds with the volume of the flowable stemming material, or its constituents, which has been fed into the borehole; and causing or allowing the flowable stemming material, or its constituents, to set so that it forms a non-flowable plug which closes off the borehole by engaging the wall of the borehole, thereby to stem the explosive in the borehole.

The method may include the step, before the explosive is fed into the borehole, of using the outlet end of the lance to push a primer/booster charge into the borehole to toe-load the charge into a blind end of the borehole as described in the Applicant's South African Patent No. 91/9810. Thus, the method may include the step, before the flowable explosive is loaded into the borehole, of using the outlet end of the lance to push a primer/booster charge into the borehole to toe-load the charge into the blind end of the borehole.

It is expected that the primer or booster charge will, in the usual fashion, be releasably supported on the top of the lance, e.g. by means of a so-called spider or miner's cap device of the usual type, which, after insertion of the lance, engages the wall of the borehole at or adjacent its blind end, to remain there with the primer or booster charge when the lance is withdrawn, the charge being associated with the usual detonating tube, fuse or the like, which trails downwardly out of the borehole.

When the borehole extends upwardly from its mouth to its blind end, the method may include the step of using a packer, provided on the outlet end of the lance, to resist flow of fluid such as flowable explosive and/or flowable stemming material downwardly under gravity past said outlet end during the feeding of the fluid into the borehole as described above, the packer being as described in above South African Patent No. 91/9810. In other words, when the borehole extends upwardly from its mouth to its blind end, the method may include the step of using a packer, mounted on the outlet end of the lance, to resist flow of fluid material downwardly under gravity past said outlet end during the loading of the borehole.

The method may include feeding constituents of a flowable emulsion explosive into the borehole by feeding an explosive base emulsion and a gassing solution into the borehole along at least one said conduit and mixing the constituents, for example by means of a static mixer, at the outlet end of the lance. Preferably, the method includes feeding the base emulsion and gassing solution along a single said conduit in the form of a central core of base emulsion with a cylindrical layer of gassing solution surrounding it, the gassing solution acting to lubricate the flow of emulsion core along the conduit.

According to another aspect of the invention there is provided a lance for loading a borehole, by feeding a plurality of different fluids into a borehole, the lance comprising a plurality of separate conduits arranged side by side.

The conduits may be hoses, pipes, tubes or the like.

The lance may have an outlet end which is provided with a homogeniser or mixer, for mixing together constituents of a flowable explosive. Accordingly, at the outlet end of the lance it may be provided with a homogeniser, such as a static mixer, for mixing together constituents of an explosive, such as an explosive base emulsion and a gassing solution. Thus, the lance may have an outlet end which is provided with a homogeniser into which a plurality of said conduits feed, for mixing together constituents of a flowable explosive.

The lance may include a packer as described in above South African Patent No. 91/9810, provided on the outlet end of the lance to resist flow of fluid downwardly under gravity past said outlet end during feeding of the fluid into the borehole. Thus, the outlet end may be provided with a packer for resisting flow of fluid downwardly under gravity past said outlet end during feeding of a fluid upwardly into a borehole.

The lance may have an inlet end at which the conduits are coupled respectively to a plurality of flexible supply hoses. The inlet end may be provided with a manifold. Thus, the lance may have an inlet end which is provided with a manifold for coupling the conduits respectively to a plurality of different liquid supplies.

The inlet ends of the conduits will, in use, be connected to fluid feed devices such as pumps, augers, piston and cylinder assemblies, or the like for urging the fluids along the conduits. As indicated above, the lance may have a manifold at its inlet end for connection to supply hoses leading to such fluid feed devices.

Naturally, routine experimentation should be employed, depending on the length and diameter of the boreholes to be loaded, the expected pressures in the conduits, the nature of the fluids to be loaded and the amount of fluid to be delivered, to determine acceptable or optimum conduit diameters and conduit wall thicknesses and conduit materials of construction.

In an embodiment of the invention, the lance may include an outer conduit or housing in the form of a primary hose, and at least two inner or secondary hoses, each secondary hose having a smaller diameter than the primary hose, the secondary hoses extending along the interior of the primary hose.

The lance may, instead, comprise a composite hose having two or more hose passages extending along its length, the composite hose being of unitary construction.

Thus, the composite hose may be one which is unitary, being formed e.g. in a single extrusion process. The hoses and/or composite hoses may, instead, be fabricated of a plastics material, steel, a reinforced material or the like, being held together side-by-side.

The invention will now be described, by way of example, with reference to the accompanying diagrammatic drawings, in which.

Figure 2:
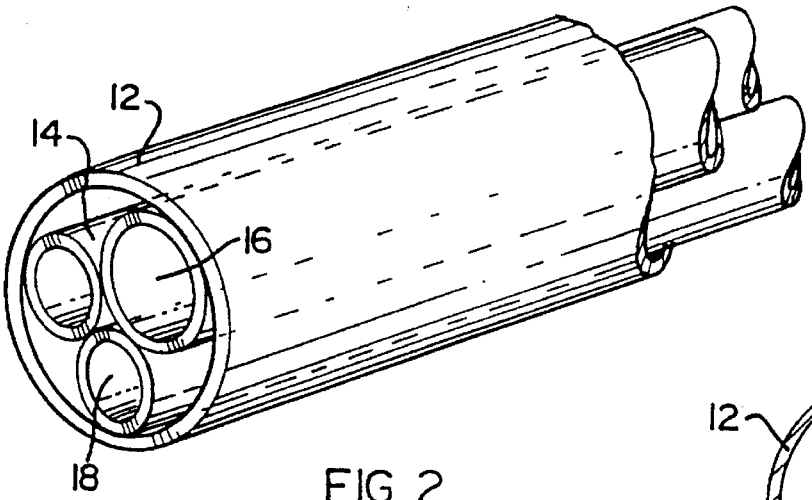
FIG. 2 shows, on an enlarged scale, a partially cut-away three-dimensional view of a portion of the lance of FIG. 1.
Figure 3:
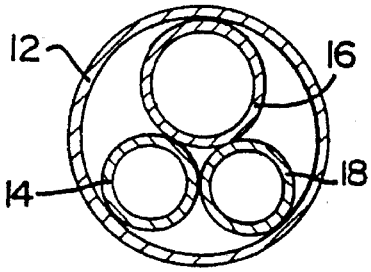
FIG. 3 shows a cross-sectional view of the hose of FIG. 2.
Figure 1:
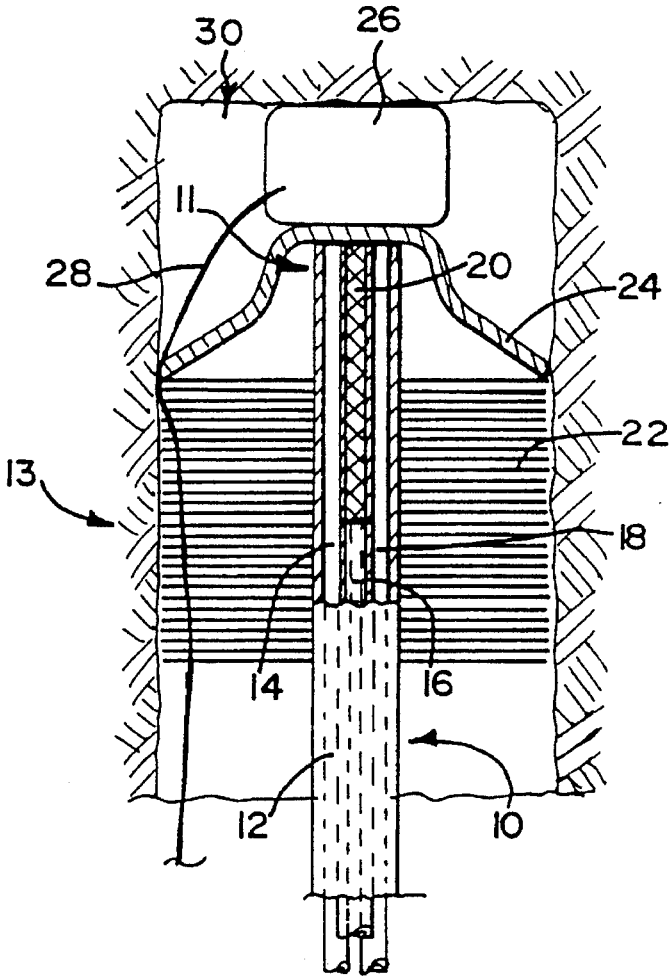
FIG. 1 shows a partly sectioned view of an outlet end portion of a lance inserted into a borehole.

Referring to the drawings, FIG. 1 shows an outlet end portion of a lance, generally indicated by reference numeral 10, having an outlet end 11 inserted into a borehole 13. The lance 10 consists of four hoses 12, 14, 16 and 18 as can be seen in FIG. 2. The hose 12 has a substantially larger diameter than the hoses 14, 16 and 18 which extend along the bore of the hose 12. The diameter of the hose 16 is slightly larger than the diameter of the hoses 14, 18. The hoses 12, 14, 16, 18 are of reinforced rubber construction.

A static mixer 20 is provided at the outlet end of the larger diameter hose 16. A bottle brush-shaped packer 22 surrounds the lance 10 adjacent its outlet end 11. A miner's cap device 24 rests on the outlet end 11 and a booster charge 26 connected to a detonating tube 28 rests on the device 24. The charge 26 is located at the blind end 30 of the borehole 13.

In use, the lance 10 is fed up into the borehole 13 by hand after the device 24 and charge 26 have been placed on top of the packer 22.

Compressed air is then injected via one of the hoses 14, 18, e.g. the hose 14 to clean the borehole 13. Pumps (not shown) then pump base emulsion and gassing solution along the larger diameter hose 16 of the lance 10, the gassing solution forming a lubricating layer around a core of base emulsion flowing along said hose 16 and being mixed with the emulsion in the mixer 20 before issuing as sensitised emulsion explosive into the top of the borehole 13 around the device 24 and charge 26.

As emulsion enters the borehole 13, the lance 10 is retracted from the borehole at a rate corresponding to, and synchronised with, the rate of feed of explosive into the borehole, so that the borehole 13 is filled progressively downwardly with explosive without any substantial leakage of explosive downwardly passed said packer 22. When about two thirds of the borehole has been loaded in this fashion, the loading is discontinued. A settable stemming material as described in the Applicant's co-pending South African Provisional Patent Application No. 92/6594 is then fed into the borehole 13 via the other of the hoses 14, 18, e.g. the hose 18. As the settable stemming material enters the borehole 13 below the explosive, the lance 10 is again retracted at a rate corresponding to, and synchronised with, the rate of feed of flowable stemming material into the borehole, so that the borehole 13 is again filled progressively downwardly without any substantial leakage of flowable stemming material downwardly passed the packer 22. The stemming material is then caused or allowed to set.

Usually several boreholes 13, bored in a pattern in e.g. a hanging wall, will be loaded in similar fashion in succession. Each detonating tube 28 will extend downwardly out of its borehole 13 and after the lance 10 has been withdrawn and removed, the explosive in the borehole can be detonated via said tubes 28.

In accordance with the invention the lance 10 will typically be associated with an underground mine vehicle (not shown), carrying an air compressor, and constituents of the emulsion explosive and stemming material in suitable containers provided with suitable fluid feed devices (pumps, augers or the like). The compressor and the fluid feed devices are respectively connected by supply hoses to a manifold (not shown) at the inlet end of the lance, via which they feed respectively into the conduits 14 (compressed air), 16 (base emulsion and gassing solution) and 18 (stemming material). The manifold will be provided with suitable valves or trigger devices for switching flow along the various conduits on and off, as desired.

The invention provides a lance which can be used, successively, to clean a borehole with air, then to load a flowable emulsion explosive into the borehole and then to load a flowable stemming material into the borehole to stem the borehole, in a single operation.

We claim:

1. A method of loading a flowable explosive into a borehole which includes, in a single operation, feeding the flowable explosive, or its constituents, and the flowable stemming material, or its constituents, successively into the borehole, by the steps of:

inserting a lance into a mouth of the borehole until an outlet end of the lance is adjacent a blind end of the borehole;

feeding the flowable explosive, or its constituents, into the borehole along a conduit of the lance;

withdrawing the lance from the borehole as the borehole receives flowable explosive, or its constituents, from the outlet end of the lance, the withdrawal and feeding being at rates which are synchronized with each other so that the volume of the borehole between said outlet end of the lance and the blind end of the borehole corresponds with the volume of flowable explosive, or its constituents, which has been fed into the borehole;

inserting a plug of the flowable stemming material into the borehole, when the flowable explosive, or its constituents, has been loaded, by feeding the flowable stemming material, or its constituents, into the borehole along another conduit of the lance;

withdrawing the lance further from the borehole, as the borehole receives the flowable stemming material, or its constituents, the further withdrawal and the feeding of the flowable stemming material being at rates which are synchronized with each other so that the volume of the borehole between said outlet end of the lance and the flowable explosive in the borehole corresponds with the volume of the flowable stemming material, or its constituents, which has been fed into the borehole; and causing or allowing the flowable stemming material, or its constituents, to set, so that it forms a non-flowable plug which closes off the borehole by engaging the wall of the borehole, thereby to stem the flowable explosive in the borehole.

2. A method as claimed in claim 1, which includes, after feeding the flowable explosive or constituents thereof into the borehole, the step of inserting a plug of a flowable stemming material into the borehole, to stem the explosive in the borehole, by feeding the flowable stemming material or constituents thereof along one of the conduits into the borehole.

3. A method as claimed in claim 1 which includes the step, before the flowable explosive is loaded into the borehole, of using the outlet end of the lance to push a primer/booster charge into the borehole to toe-load the charge into the blind end of the borehole.

4. A method as claimed in claim 1 in which the borehole extends upwardly from its mouth to its blind end, the method including the step of using a packer, mounted on the outlet end of the lance, to resist flow of fluid material downwardly under gravity past said outlet end during the loading of the borehole.

5. A method as claimed in claim 1 which includes feeding constituents of a flowable emulsion explosive into the borehole by feeding an explosive base emulsion and a gassing solution into the borehole along at least one said conduit, and mixing the constituents at the outlet end of the lance.

6. A method as claimed in claim 5, which includes feeding the base emulsion and the gassing solution along a single conduit in the form of a central core of base emulsion with a cylindrical layer of gassing solution surrounding it.

* * * * *